US009140103B2

(12) United States Patent
Larsson et al.

(10) Patent No.: US 9,140,103 B2
(45) Date of Patent: Sep. 22, 2015

(54) GUIDEPOST EXTENSION

(75) Inventors: Johan Larsson, Årjäng (SE); Mathias Larsson, Årjäng (SE)

(73) Assignee: AKER AUBDEA AS, Lysaker (NO)

( * ) Notice: Subject to any disclaimer, the term of this patent is extended or adjusted under 35 U.S.C. 154(b) by 155 days.

(21) Appl. No.: 13/988,026

(22) PCT Filed: Nov. 18, 2011

(86) PCT No.: PCT/NO2011/000324

§ 371 (c)(1),
(2), (4) Date: May 17, 2013

(87) PCT Pub. No.: WO2012/067520

PCT Pub. Date: May 24, 2012

(65) Prior Publication Data

US 2013/0240213 A1 Sep. 19, 2013

(30) Foreign Application Priority Data

Nov. 18, 2010 (NO) ..... 20101624

(51) Int. Cl.
*E21B 7/12* (2006.01)
*E21B 41/10* (2006.01)

(52) U.S. Cl.
CPC ..... *E21B 41/10* (2013.01)

(58) Field of Classification Search
CPC ..... E21B 33/038; E21B 41/10; E21B 43/013
USPC ..... 166/342, 351, 360
See application file for complete search history.

(56) References Cited

U.S. PATENT DOCUMENTS

| | | | | | |
|---|---|---|---|---|---|
| 3,050,139 | A | * | 8/1962 | Hayes | 175/7 |
| 3,236,302 | A | * | 2/1966 | Postlewaite | 166/341 |
| 3,545,539 | A | * | 12/1970 | Manning | 166/356 |
| 3,954,137 | A | | 5/1976 | Baugh | |
| 4,426,173 | A | * | 1/1984 | Richart et al. | 405/195.1 |
| 4,439,068 | A | * | 3/1984 | Pokladnik | 405/169 |
| 4,523,878 | A | * | 6/1985 | Richart et al. | 405/195.1 |
| 4,591,296 | A | * | 5/1986 | Henderson et al. | 405/195.1 |
| 4,789,271 | A | * | 12/1988 | Sullaway et al. | 405/225 |
| 4,828,035 | A | * | 5/1989 | McInturff | 166/339 |
| 4,867,605 | A | * | 9/1989 | Myers et al. | 405/169 |

(Continued)

FOREIGN PATENT DOCUMENTS

| | | | |
|---|---|---|---|
| GB | 2255992 | A | 11/1992 |
| WO | WO 2005/083228 | A1 | 9/2005 |

*Primary Examiner* — Matthew Buck
*Assistant Examiner* — Aaron Lembo
(74) *Attorney, Agent, or Firm* — Birch, Stewart, Kolasch & Birch, LLP

(57) ABSTRACT

A releasable guidepost extension is used on the seabed together with a bottom fixed guidepost part. These parts make up a guidepost for use during the lowering of a component from the surface of the water to a subsea structure. The guidepost part includes an upward (in use position) projecting end designed for engagement with a lower (in use position) end of the guidepost extension. The guidepost extension is loosely connected to the bottom fixed guidepost part via a pin and socket part on respective ends. A gap, or clearance, exists between the pin and socket part in the longitudinal direction, and at least one friction forming device arranged in the gap on either the pin part or in the socket part. The friction forming device does not get in contact, or engaged, with the other part unless the guidepost extension is subjected to a lateral force.

20 Claims, 6 Drawing Sheets

(56) References Cited

U.S. PATENT DOCUMENTS

Figure 1:
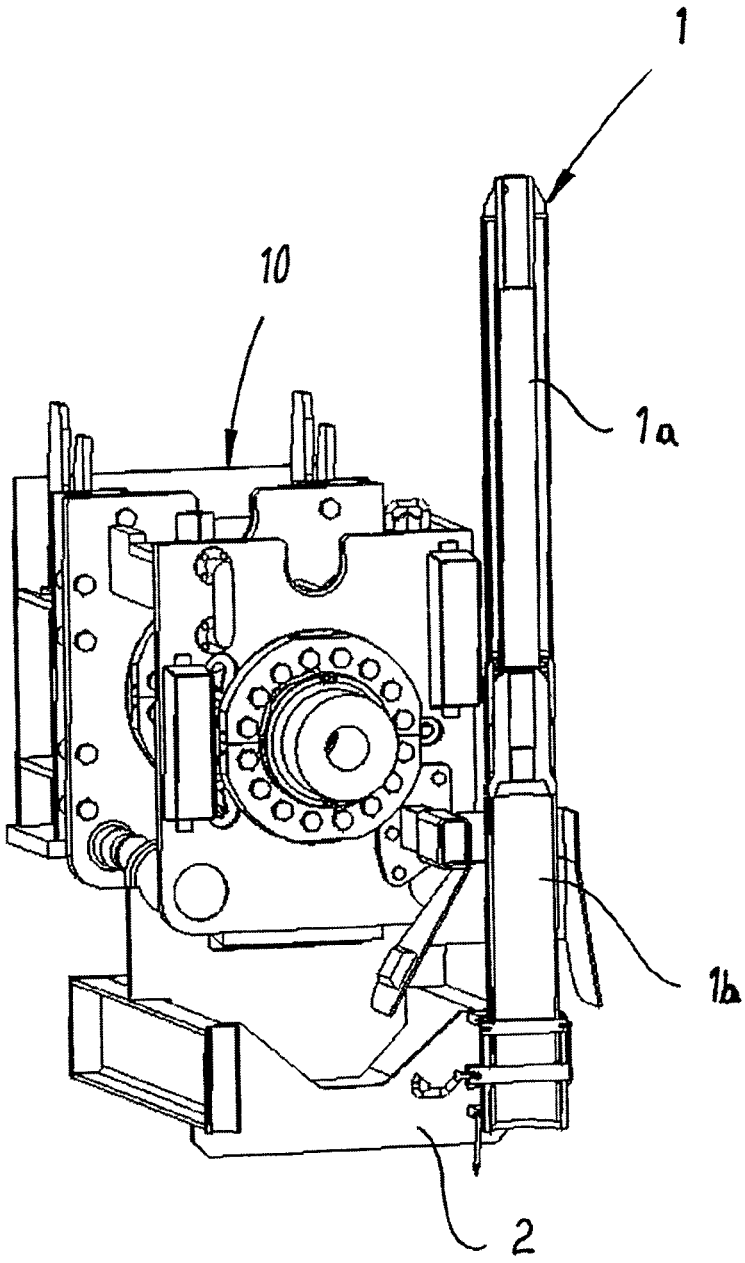

| | | | | |
|---|---|---|---|---|
| 4,881,850 | A * | 11/1989 | Abreo, Jr. | 405/169 |
| 4,927,295 | A * | 5/1990 | Knowles | 405/195.1 |
| 5,005,650 | A * | 4/1991 | Hopper | 166/339 |
| 5,088,556 | A * | 2/1992 | Short et al. | 166/339 |
| 8,517,110 | B2 * | 8/2013 | Trent | 166/355 |
| 8,720,580 | B1 * | 5/2014 | Lugo | 166/344 |
| 8,794,336 | B2 * | 8/2014 | Bekkevold | 166/380 |
| 2009/0025936 | A1 | 1/2009 | Donald et al. | |
| 2013/0098626 | A1 * | 4/2013 | Baker et al. | 166/341 |
| 2014/0186120 | A1 * | 7/2014 | Hestetun | 405/169 |

* cited by examiner

GUIDEPOST EXTENSION

The present invention relates to a releasable guidepost extension for use on the seabed together with a seabed fixed guidepost part, which parts together make up a guidepost for assistance during lowering of a component from the surface of the water to a subsea structure to obtain a focused landing of said component at a predetermined location, said guidepost part includes an upward (in the position of use) projecting end designed for engagement with a lower (in the position of use) end of the guidepost extension.

In the lowering of subsea equipment towards a structure or construction on the seabed, such as a manifold or a wellhead, guidelines are often used, usually steel ropes. Each guideline terminates in a guidepost which is fixed to and projects from the structure on the seabed. The guidepost is used to locate components on seabed bases or foundations during oil drilling or production operations, or in order to install modules on top of each other. In the drilling of a subsea well, for example, a template guiding foundation is placed around the conductor casing of a well that is drilled. The guiding foundation has guideposts and these are used to position a blowout preventer BOP on top of the wellhead. Guideposts can also be used to install and position other modules, for example to guide and position a lower riser package on a blowout preventer, or an emergency disconnect package on a well workover safety valve.

Such guideposts provide a coarse alignment between the equipment and wellhead and provide vertical stability in the system in order to be able to make up connection to the wellhead. Final alignment is performed by the connector itself. Normally four guide wires and four posts will be used during a lowering operation.

A problem with traditional guideposts of this nature is that they are very long and project higher up in the water than the equipment itself and thus is more exposed to damages from fish trawls and similar.

Guidepost extensions have therefore been developed and introduced in the later years, and such an extension is contemporary put onto and extends a shorter, fixedly mounted guidepost part. They are such designed that the bottom fixed part has a receiving end that is able to receive a pin end on the guidepost extension and the post parts can be locked to each other by mechanical locking means.

This known solution (prior art) is based on guide wire and standard upwards projecting guidepost extension. The guidepost extension is hollow and the guide wire extends there through and further on to a wire anchor with pawls that are anchored to the guidepost part which, when they are activated, lock the post parts together.

The now proposed solution is using the upwards projecting guidepost extension as kind of a tool, i.e. move the tool around between the respective guideposts, which are stationary deployed at predetermined locations on the bottom structure, on a seabed structure according to needs to have the job done and then retrieve that one/those ones (at least one short and one long) up to the surface. The guide posts project often 3.5 meters. As mentioned, the guideposts project above the bottom structure and will be a risk for fishing nets etc. and need to be removed.

To be able to move one (two) isolated guidepost(s) around from place to place by one ROV will be cost effective, contra the use of one guidepost equipped with a guide wire that need to be secured to the base of the guidepost by pawl mechanisms, and subsequently released again from these, for each place.

At the same time use of guide wire from the surface is avoided, which is no longer needed due to good and easily maneuverable ROVs. Guide wire is very time consuming to deploy, in addition to that their costs are substantial, in particular in deeper waters. For example, the Goa field offshore the African coast is 1200 meters deep.

Normally two guideposts are needed, the one longer than the other. Usually, a funnel means on the component to be lowered needs to enter the long post first. Then the component is orientated by revolving in the horizontal plane until funnel means no. two is located right above the shorter guidepost. Then the component is lowered onto the shorter guide post extension and further down the first post.

With the new solution, the total weight of the removable guidepost is made possible to reduce, i.e. that it will now weight about 44 kg. Normally a ROV will be able to lift about 50-70 kg.

According to the present invention a guidepost extension of the introductory said kind is provided, which is distinguished in that the guidepost extension is loosely connected to the seabed fixed guidepost part via a pin and socket part on respective ends, that a gap, or clearance, exists between the pin and socket part in the longitudinal direction thereof, and that at least one friction forming means is arranged in the gap on either the pin part or in the socket part, said at least one friction forming means do not get in contact, or engaged, with the other part unless the guidepost extension is subjected to a lateral force.

The theory is that by applying laterally acting forces against the guidepost extension, this extension will tilt and the socket or sleeve part thereof will pinch to the pin part and the pinching is supposed to be substantially enhanced by use of said friction forming means. The higher up the lateral forces are acting on the guidepost extension, the longer moment arm is acting and correspondingly higher pinch forces are achieved.

Contrary, the guidepost extension can only be removed in that the extension is lifted approximately vertically straight upwards (by an ROV). As soon as it tilts, it will pinch. The tendency to tilting will take place all the time during a landing operation of a component onto a bottom structure, but this does not matter. This only keeps the guidepost extension still firmer in place. If there is no tilting during lowering, this does neither matter, and then the guidepost extensions stand in place by their own gravity.

In a first embodiment the guidepost extension includes the socket part itself; while the seabed fixed guidepost part includes the pin part.

In a second embodiment, or variant, the seabed fixed guidepost part includes the socket part and the guidepost extension has the pin part.

In a practical embodiment the friction forming means can be in the form of an O-ring, that is either arranged internally within the socket part or externally to the pin part and in grooves provided in the internal/external surface of the part.

Preferably, the O-ring is made of an elastomeric material, such as a rubber mixture or similar. This solution will be particularly well suited if an existing pin or socket end is already standing on the seabed and only the guidepost extension is to be replaced with a new one, i.e. modify existing equipment.

In still another embodiment, the internal surface of the socket part is divided in an upper surface having smaller diameter and a lower surface having somewhat larger diameter and where an O-ring is arranged on each respective surface. This means that the guidepost extension is somewhat reduced in diameter relative to the socket part, which in turn has reduced diameter relative to the guidepost part. The part has such geometric configuration that abutment only takes place at one spot.

In still another embodiment at least one fluid passage is arranged through the wall of the socket part somewhere between the friction forming means.

In an alternative embodiment the friction forming means can be in the form of tongue and groove means, where the tongue is able to make a mechanical engagement with the groove. This solution will probably be preferred if a delivery of complete guideposts for an equipment takes place before deployment has been done.

In still an alternative embodiment, the friction forming means can be in the form of a layer of elastomeric material, such as rubber, arranged in the gap between the pin and socket parts.

In still an alternative embodiment the friction forming means can be in the form of a metallic ring arranged in the gap between the pin and socket parts. The metallic ring can have any suitable cross section profile that is able to pinch against a surface.

The guidepost extension can preferably be in order of magnitude 1 to 3 meters long.

At least one of the parts, the pin end or the socket end, can be coated with a slippery material, for example Teflon or similar.

The clearance existing between the pin end and the socket end will conveniently be in order of magnitude about 1 mm without this being construed as a limitation. In one embodiment, the external diameter of the pin can be about 180 mm, just as an example. As another an example, two internal O-rings can be placed approximately 300 mm apart internally of the socket or sleeve part. Ideally viewed, the O-rings do not touch the pin.

Figure 2:
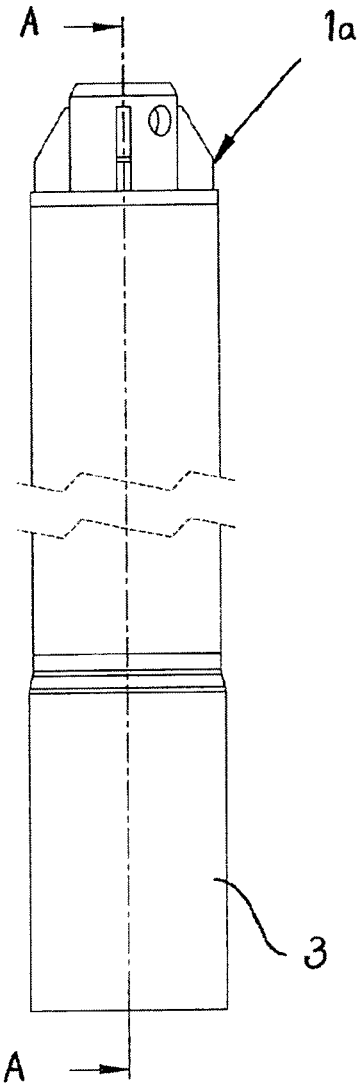
Figure 3:
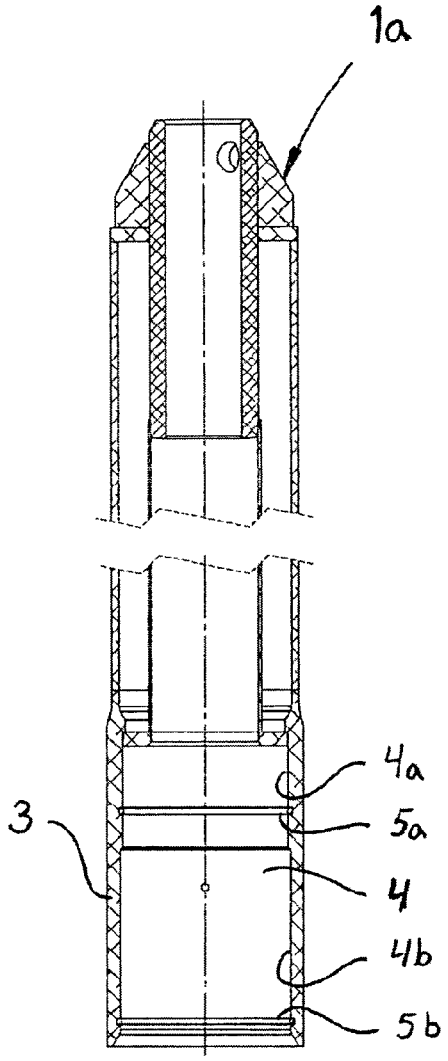
Figure 4A:
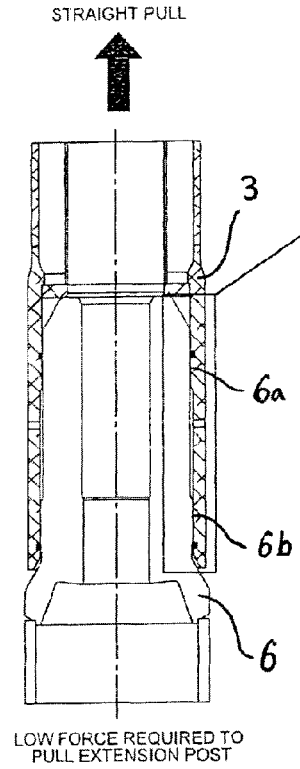
Figure 4B:
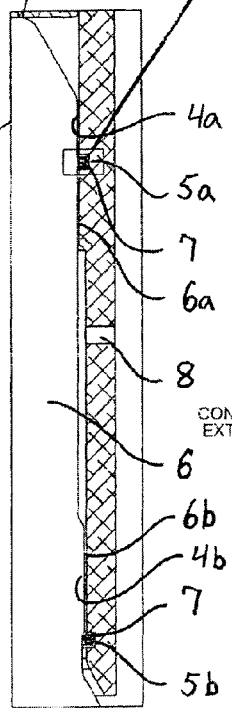
Figure 4C:
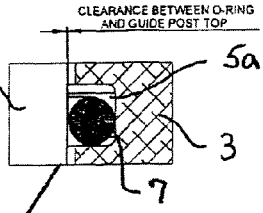
Figure 5:
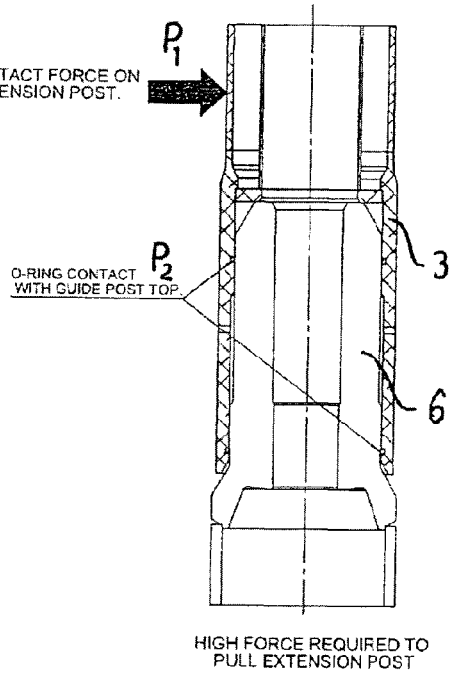
Figure 10A:
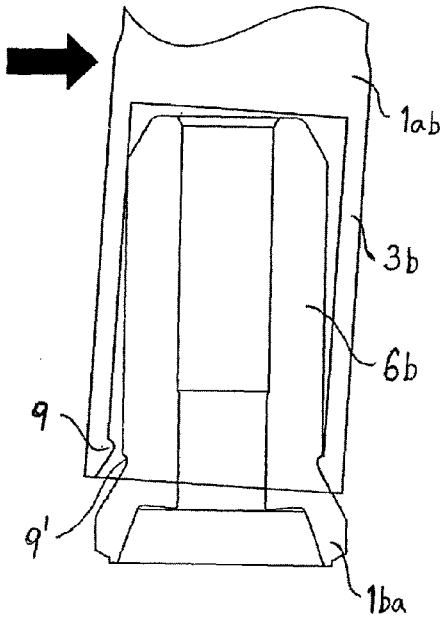
Figure 10B:
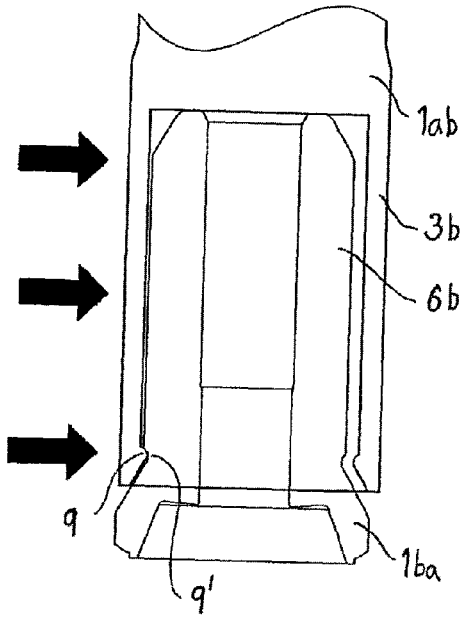
Figure 4D:
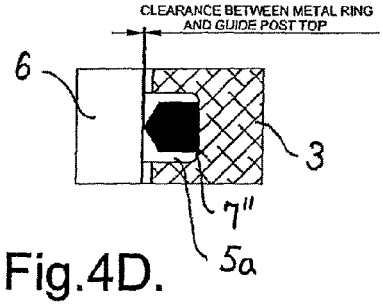
Figure 4E:
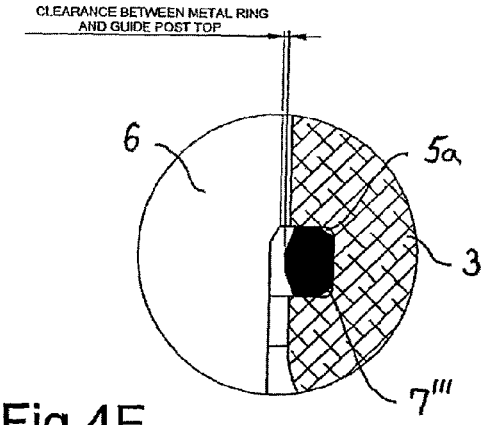
Figure 6A:
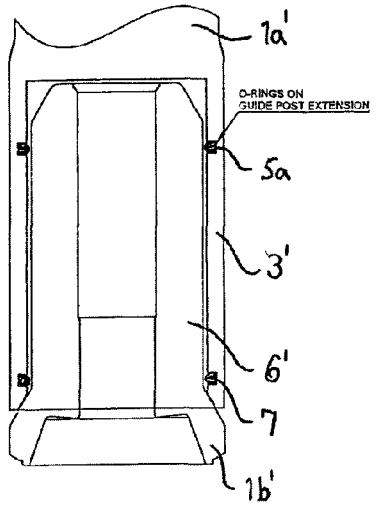
Figure 6B:
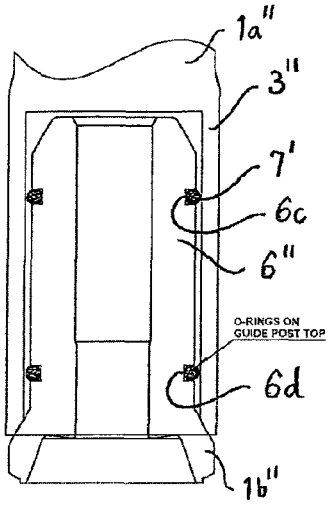
Figure 7A:
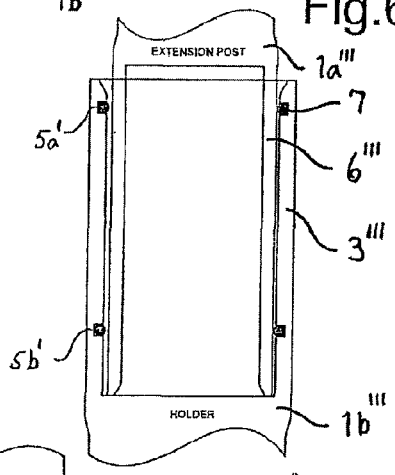
Figure 7B:
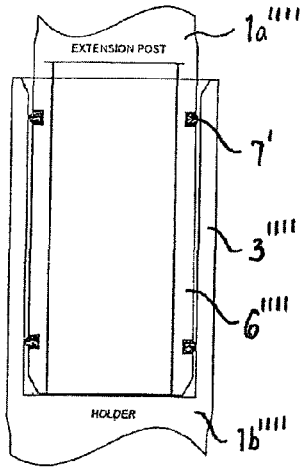
Figure 8A:
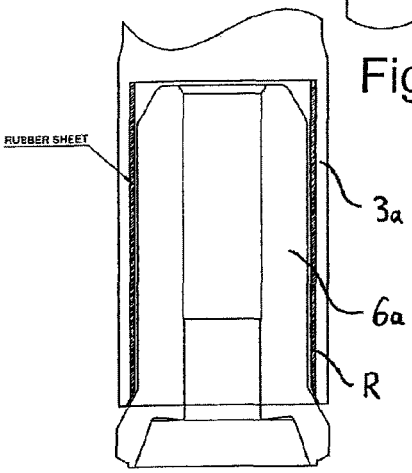
Figure 8B:
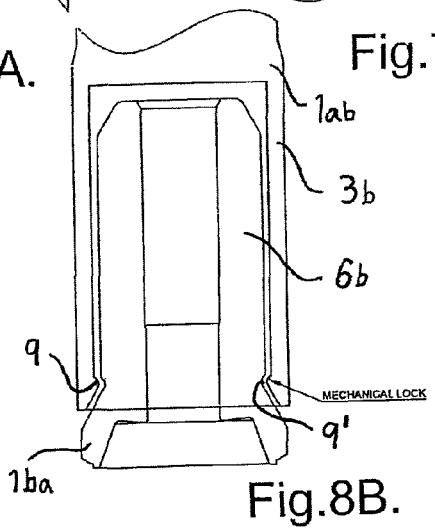
Figure 9:
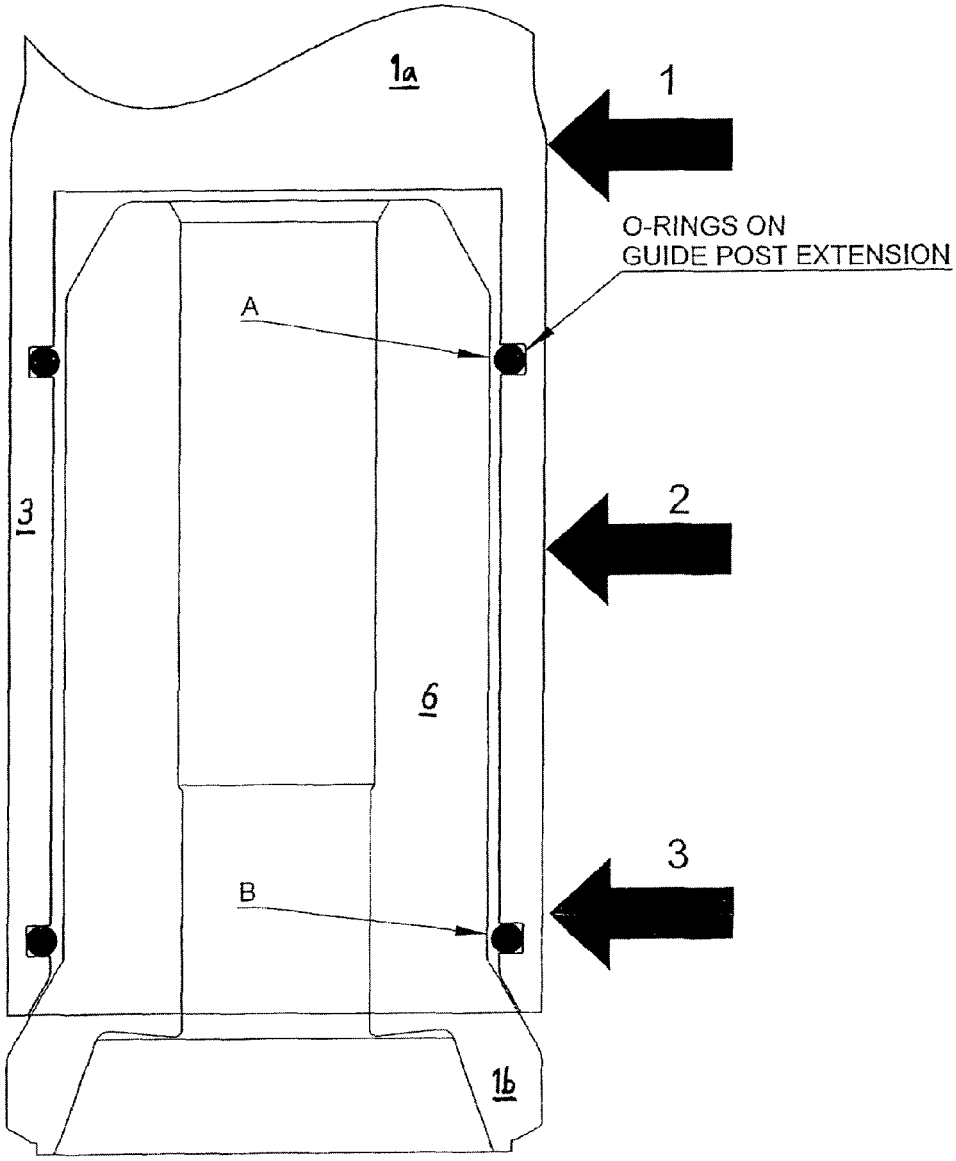

Other and further objects, features and advantages will appear from the following description of preferred embodiments of the invention, which are given for the purpose of description, and given in context with the appended drawings where:

FIG. 1 shows in perspective view a connector together with a guidepost according to the invention, FIG. 2 shows an elevation view of a guidepost extension according to the invention, FIG. 3 shows a longitudinal cross section along the line A-A in FIG. 2, FIG. 4A shows a guidepost extension stabbed onto a lower post part, FIG. 4B shows an enlarged detail of FIG. 4A, FIG. 4C shows a further enlarged detail of FIGS. 4A and 4B, FIG. 4D shows a variant of the embodiment shown in FIG. 4C, FIG. 4E shows another variant of the embodiment shown in FIGS. 4C and 4D, FIG. 5 illustrates a situation where the guide post extension is subjected to a lateral force, FIGS. 6A and 6B show a first embodiment in two variants of guidepost joints, FIGS. 7A and 7B show a second embodiment in two variants of guidepost joints, FIGS. 8A and 8B show further two embodiments of guidepost joints, FIG. 9 illustrates three contemplated situations 1, 2, 3, for applying lateral force to the guide post (resultant force), FIG. 10A shows a situation where the guide post extension according to FIG. 8B tilts and hooks, and FIG. 10B shows a situation where the guide post extension according to FIG. 8B hooks by a lateral force.

Reference is first made to FIG. 1 that generally shows a connector 10 and an associated guidepost 1, which is designed according to the present invention. The guidepost 1 is divided in two, i.e. a fixed, lower post part 1*b* projecting from a bottom, or seabed, structure 2, and a releasable upper guidepost extension 1*a*, which in principle can be moved around by assistance of a ROV and be put onto corresponding lower post parts 1*b* at other places.

FIG. 2 schematically shows an elevation view of a typical guidepost extension 1*a* having a socket joint 3 in its lower end. The socket joint 3 constitutes an enlargement of the lower end of the guidepost extension 1*a*, i.e. that the external diameter of the socket 3 is somewhat larger than the diameter of the guidepost extension 1*a* itself.

FIG. 3 shows the guidepost extension 1*a* in longitudinal section along the line A-A in FIG. 2. The upper part is per se of traditional design and is not described in closer detail here, other than it is of a very rigid and sturdy nature. As apparent from FIG. 3, the inner wall 4 of the socket joint 3 is reduced, or stepped down. This means that the upper part 4*a* of the internal wall 4 of the socket 3 has a somewhat smaller internal diameter than the lower part 4*b*. Moreover, internal upper and lower grooves 5*a*, 5*b* are machined in the upper part 4*a* and lower part 4*b* respectively. Each groove 5*a*, 5*b* is designed for receipt of an O-ring of suitable material and nature. At the very lowermost portion, the lower part 4*b* is beveled such that this part appears as conical over a short portion below the lower groove 5*b*.

FIG. 4A shows a situation where the socket 3 of the guidepost extension 1*a* is threaded over a pin end 6, which constitute the upper part of the fixed, lower post part 1*b*. The external configuration and diameter of the pin end 6 is adapted to the internal configuration and diameter of the socket 3 such that these parts are complementary to each other, though with a clearance between the surfaces. Thus it is to be understood that the pin end 6 is ledged, or stepped, i.e. with a lower peripheral surface 6*b* having somewhat larger diameter than an upper peripheral surface 6*a*. Moreover, the upper end is beveled as a conically formed end termination thereby enabling adequate entering of the socket 3 onto the pin end 6, even if they do not hit each other perfectly.

FIG. 4B shows an enlarged detail of FIG. 4, more precisely that part which is circumscribed by a rectangle to the right hand side of the figure. It is clearly shown in this figure that each groove 5*a*, 5*b* is filled by an O-ring 7. The reduction between the peripheral surfaces 6*a*, 6*b* on the pin end 6 and corresponding reduction on the socket surfaces 4*a*, 4*b* is here more visible. It is also to be noted that a hole 8 is made in the socket wall at a location between upper and lower O-ring 7. This is made to prevent potential pressure build up in the annulus between upper and lower O-ring 7. It is to be understood that the lower conical part of the socket 4 is not intended to abut against corresponding conical surface of the lower part of the pin end 6, but that a certain clearance between these surfaces exists. The weight of the guidepost extension 1*a* rests in entirety on the top surface 6*f* of the pin end 6.

FIG. 4C shows a further enlarged detail of FIG. 4B where the O-ring 7 and the groove 5*a* are still more enlarged. FIG. 4C illustrates in a clear way, firstly the clearance between the peripheral surface 6*a* of the pin end 6 and the internal surface 4*a* of the socket 3, and a smaller clearance between the O-ring 7 itself and the peripheral surface 6*a*. Thus it is to be understood that parts of the O-ring 7 always will need to project out from the groove 5*a* in order to achieve intended effect between an O-ring 7 and a pin end surface.

FIG. 4D shows one embodiment where the O-ring 7 is replaced by a metallic ring 7" which is inserted in respective grooves 5*a*, 5*b*. This embodiment shows a pointed attack surface, or engagement surface, which is able to pinch or bite against the surface of the pin end 6.

FIG. 4E shows still another embodiment where the O-ring 7 is replaced by a metallic ring 7' which is inserted in respective grooves 5*a*, 5*b*. This embodiment shows a tapered engagement surface that is beveled and able to make engagement with an edge at the lower end of the pin end 6. It is therefore to be understood that the transverse cross section of the metallic ring can have any type of profile suited for such purpose.

FIG. 5 is to illustrate a situation where the guidepost extension 1*a* is subjected to a lateral force such as the thick arrow $P_1$ shows. Thereby the contact points will be in the area where the thin arrows $P_2$ show, namely proximal at the upper O-ring 7 and distal at the lower O-ring 7. Under such a situation, extremely high pulling forces are required to lift the guidepost extension 1*a* off from the pin end 6.

FIGS. 6A and 6B show a first embodiment of guide post joints and can be embodied in two variants as shown in the two figures. FIG. 6A is entirely corresponding to that already shown and described in connection with the FIGS. 4 and 5, except that the reduction, or step down, is missing. The pin end 6' is arranged on top of the lower fixed post part 1*b'*, while the socket end 3' is arranged on the lower end of the guidepost extension 1*a'*. The O-rings 7 are arranged internally in grooves 5*a*, 5*b* within the socket part 3'. FIG. 6B shows a variant where the O-rings 7' are arranged in grooves 6*c*, 6*d* on the pin end 6" itself, and not within the socket end 3". The pin end 6", now with grooves, is like FIG. 6A, provided on top of the lower fixed post part 1*b"*, and the socket end 3", now without grooves, is provided on the lower end of the guidepost extension 1*a"*. Otherwise, the guidepost will be similar to the FIG. 6A embodiment.

FIGS. 7A and 7B show a second embodiment of guide post joints, and this one too can be embodied in two variants as shown in the two figures. The socket end 3'" is now arranged on top of the lower fixed post part 1*b'"*, while the pin end 6'" now is arranged on the lower end of the guidepost extension 1*a'"*. The O-rings 7 are arranged in grooves 5*a'*, 5*b'* internally of the socket part 3'". FIG. 7B shows a variant where the O-rings 7' are arranged in grooves 6*c'*, 6*d'* on the pin end 6"" itself. The socket end 3"", now without grooves, is like in FIG. 7A provided on top of the lower fixed post part 1*b""*, and the pin end 6"", now with grooves, is provided on the lower end of the guidepost extension 1*a""*. Otherwise, the guidepost will be similar to the FIG. 7A embodiment.

FIG. 8A shows an embodiment where either the internal surface of the socket 3*a*, or the external surface of the pin end 6*a*, is lined with a layer of elastomeric material, such as rubber R.

FIG. 8 shows an embodiment that deviates from the use of O-rings and instead has a pure mechanical locking. It is designed with a ring formed locking lug 9 in the lower end of the socket 3*b*, which lug is able to engage with an annular groove 9' configured in the lower throat of the pin end 6*b*. When a guidepost extension lab is subjected to lateral forces, a sector of the annular locking lug 9 engages with a corresponding sector of the annular groove 9' and thereby prevents pulling the guidepost extension 1*ab* off from the pin end 6*b* on the lower post part 1*ba*.

With reference to FIG. 9, the theory behind the invention will be outlined. FIG. 9 is meant to illustrate three different, conceived situations 1, 2, 3 for applying lateral force (resultant force) against a guidepost extension 1*a*. What it is based upon, is that when the pinch effect is absent and the load is applied in level with arrow 1, the O-ring A will be forced against the pin end 6 or the pin. The O-ring will represent an area having a material with high friction factor. When the load is applied in level with arrow 2, then the O-rings A and B will be forced against the pin. When the load is applied in level with arrow 3, then the O-ring B will be forced against the pin. This shall therefore provide a higher friction than what the load provides against the pin. It is therefore to be understood that it is the friction which makes it possible in this embodiment that no mechanical lock is needed.

With reference to FIG. 10A, a situation is shown where the guidepost extension according to FIG. 8B is subjected to a lateral force according to arrow 1 in FIG. 9. Thereby the guidepost extension 1*a* tilts and an upper point on the internal surface of the socket part hits and engages a point on the upper part of the pin end 6, while on the same side and in lower part the annular locking lug 9 will move away from the annular groove 9', while on opposite side and in the lower part the annular locking lug 9 will hook mechanically with the annular groove 9', such as FIG. 10A illustrates. Thus the guidepost extension 1*a* can not be pulled off from the pin end 6.

With reference to FIG. 10B, a situation is shown where the guidepost extension according to FIG. 8B is subjected to a lateral force according to the arrows 1+2+3 in FIG. 9. Thereby the guidepost extension 1*a* moves sideways and in parallel with the pin end 6 and the internal surface of the socket part 3 hits and engages the pin end 6 by line contact. On the same side and in the lower part the annular locking lug 9 will move towards the annular groove 9' and hook mechanically with the annular groove 9', while on opposite side the annular locking lug 9 will move away from the annular groove 9', such as FIG. 10B illustrates. Thus the guidepost extension 1*a* can not be pulled off from the pin end 6.

The invention claimed is:

1. A releasable guidepost extension for use on the seabed together with a seabed fixed guidepost part, which parts together make up a guidepost for assistance during lowering of a component from the surface of the water to a subsea structure to obtain a focused landing of said component at a predetermined location, said guidepost part includes an upward (in the position of use) projecting end designed for engagement with a lower (in the position of use) end of the guidepost extension, wherein the guidepost extension is loosely connected to the seabed fixed guidepost part via a pin and socket part on respective ends, such that a gap, or clearance, exists between the pin and socket part in the longitudinal direction thereof, and wherein at least one friction forming device is arranged in the gap on either the pin part or in the socket part, and said at least one friction forming device does not get in contact, or is not engaged, with the other part unless the guidepost extension is subjected to a lateral force.

2. A releasable guidepost extension according to claim 1, wherein the guidepost extension comprises the socket part and the seabed fixed guidepost part comprises the pin part.

3. A releasable guidepost extension according to claim 1, wherein the seabed fixed guidepost part comprises the socket part and guidepost extension comprises the pin part.

4. A releasable guidepost extension according to claim 1, wherein the at least one friction forming device is in the form of an O-ring, that is either arranged internally of the socket part or externally on the pin part and in grooves provided in the internal or external surface of the part.

5. A releasable guidepost extension according to claim 4, wherein the O-ring is of an elastomeric material, such as a rubber mixture.

6. A releasable guidepost extension according to claim 1, wherein the internal surface of the socket part is divided in an upper surface having smaller diameter, and a lower surface having somewhat larger diameter, and that an O-ring is arranged on each respective surface.

7. A releasable guidepost extension according to claim 1, wherein at least one fluid passage is arranged through the wall of the socket part somewhere between the at least one friction forming device.

8. A releasable guidepost extension according to claim 1, wherein the at least one friction forming device is in the form of tongue and groove, said tongue and groove engaging with each other and being configured to make a mechanical engagement.

9. A releasable guidepost extension according to claim 1, wherein the at least one friction forming device is in the form of a layer of elastomeric material arranged in the gap between the pin and socket parts.

10. A releasable guidepost extension according to claim 1, wherein the at least one friction forming device is in the form of a metallic ring arranged in the gap between the pin and socket parts.

11. A releasable guidepost extension according to claim 1, wherein the guidepost extension is in order of magnitude 1 to 3 meters long.

12. A releasable guidepost extension according to claim 1, wherein at least one of the parts, the pin end or the socket end, is coated with a slippery material.

13. A releasable guidepost extension according to claim 1, wherein the clearance existing between the pin end and the socket end is in order of magnitude about 1 mm.

14. A releasable guidepost extension according to claim 2, wherein the at least one friction forming device is in the form of an O-ring, that is either arranged internally of the socket part or externally on the pin part and in grooves provided in the internal or external surface of the part.

15. A releasable guidepost extension according to claim 3, wherein the at least one friction forming device is in the form of an O-ring, that is either arranged internally of the socket part or externally on the pin part and in grooves provided in the internal or external surface of the part.

16. A releasable guidepost extension according to claim 2, wherein the internal surface of the socket part is divided in an upper surface having smaller diameter, and a lower surface having somewhat larger diameter, and that an O-ring is arranged on each respective surface.

17. A releasable guidepost extension according to claim 3, wherein the internal surface of the socket part is divided in an upper surface having smaller diameter, and a lower surface having somewhat larger diameter, and that an O-ring is arranged on each respective surface.

18. A releasable guidepost extension according to claim 4, wherein the internal surface of the socket part is divided in an upper surface having smaller diameter, and a lower surface having somewhat larger diameter, and that an O-ring is arranged on each respective surface.

19. A releasable guidepost extension according to claim 2, wherein at least one fluid passage is arranged through the wall of the socket part somewhere between the at least one friction forming device.

20. A releasable guidepost extension according to claim 1, wherein the upward projecting end of the guidepost part forms the pin, the lower end of the guidepost extension forms the socket part, and the guidepost extension is loosely connected to the seabed fixed guidepost part by inserting the pin into the socket part.

* * * * *

UNITED STATES PATENT AND TRADEMARK OFFICE

CERTIFICATE OF CORRECTION

PATENT NO. : 9,140,103 B2
APPLICATION NO. : 13/988026
DATED : September 22, 2015
INVENTOR(S) : Johan Larsson et al.

It is certified that error appears in the above-identified patent and that said Letters Patent is hereby corrected as shown below:

ON THE TITLE PAGE:

At item (73), Assignee, change "AKER AUBDEA AS, Lysaker (NO)" to --AKER SUBSEA AS, Lysaker (NO)--.

Signed and Sealed this
Twenty-ninth Day of March, 2016

Michelle K. Lee

Michelle K. Lee
*Director of the United States Patent and Trademark Office*